United States Patent [19]

Smith et al.

[11] Patent Number: 4,853,564

[45] Date of Patent: Aug. 1, 1989

[54] GAAS MONOLITHIC TRUE LOGARITHMIC AMPLIFIER

[75] Inventors: Mark A. Smith, Dallas; Anthony M. Pavio, Plano, both of Tex.

[73] Assignee: Texas Instruments Incorporated, Dallas, Tex.

[21] Appl. No.: 194,798

[22] Filed: May 17, 1988

[51] Int. Cl.[4] ..... G06G 7/24

[52] U.S. Cl. ..... 307/492; 307/242; 307/571; 307/497; 328/145

[58] Field of Search ..... 307/450, 571, 241–243, 307/492–494, 497; 328/145

[56] References Cited

U.S. PATENT DOCUMENTS

| | | | |
|---|---|---|---|
| 3,129,343 | 4/1964 | Logan | 307/492 |
| 3,373,294 | 3/1968 | Fujinami | 307/492 |
| 3,448,289 | 6/1969 | Harris | 307/492 |
| 3,492,497 | 1/1970 | Gilmour et al. | 307/492 |
| 3,509,368 | 4/1967 | Pedersen | 307/492 |
| 4,507,615 | 3/1985 | Bateman | 328/142 |

*Primary Examiner*—Stanley D. Miller
*Assistant Examiner*—Nancy Thai
*Attorney, Agent, or Firm*—Rene' E. Grossman; N. Rhys Merrett; Melvin Sharp

[57] ABSTRACT

A GaAs monolithic true logarithmic amplifier which includes at least one amplifier stage common to the two arms of the circuit, the two arms being independent thereafter, one having lower gain and higher compression point and the other arm having higher gain and lower compression point. The signals in the arms are then recombined off-chip to provide the same effect as in the prior art. The circuit includes an input stage which amplifies and gain shapes the input signal and then splits the signal into upper and lower paths. The upper path is a relatively lower gain and higher compression point path whereas the lower path is a relatively higher gain and lower compression point path. The upper path includes a FET with a very large gate width whereas the lower path includes plural cascaded FETs, the last of which has a very small gate width. The upper and lower paths both have an odd or an even number of FETs to maintain the phase relation therebetween, the upper path further including transmission line stubs or elements which act as a delay line to compensate for the delay in the lower path due to the larger number of FETs therein. The outputs of the upper and lower paths are combined in a resistive combiner to provide the amplified signal. The output of this circuit is linear at low power and then demonstrates a knee therein at higher input power to resemble the curve of a logarithmic amplifier.

26 Claims, 2 Drawing Sheets

GAAS MONOLITHIC TRUE LOGARITHMIC AMPLIFIER

BACKGROUND OF THE INVENTION

1.Field of the Invention

This invention relates to logarithmic amplifiers and, more specifically, to GaAs monolithic true logarithmic amplifiers.

2.Brief Description of the Prior Art

Prior art true logarithmic amplifiers are generally formed in silicon wafer and operate in the range of several hundred megahertz center frequency with a bandwidth of about 100 to 200 megahertz. Such prior art true logarithmic amplifiers have generally been composed of two circuit halves, each circuit half having a differential circuit pair per stage. The differential circuit pairs operate in parallel, one circuit pair having higher gain and a lower compression point and the other circuit having lower gain and a higher compression point. Together, these half circuits provide an amplifier response having a kink therein. It is desirable to utilize such true logarithmic amplifiers, however with the capability of operation at higher frequencies and/or with greater bandwidth.

SUMMARY OF THE INVENTION

In accordance with the present invention, the above noted problem of prior art true logarithmic amplifiers is overcome and there is provided a true logarithmic amplifier which is capable of operation with a center frequency of up to about 4 gigahertz.

Briefly, the above is accomplished by utilizing GaAs monolithic circuitry. The circuit includes a first amplifier stage common to the two arms of the circuit, the two arms being independent thereafter, one having lower gain and higher compression point and the other arm having higher gain and lower compression point. The signals in the arms are then recombined off-chip to provide the same effect as in the prior art.

The circuit includes an input stage which amplifies and gain shapes the input signal and then splits the signal into upper and lower paths. The upper path is a relatively lower gain and higher compression point path whereas the lower path is a relatively higher gain and lower compression point path. The upper path includes an FET with a very large gate width whereas the lower path includes plural cascaded FETs, the last of which has a very small gate width. The upper and lower paths both have an odd or an even number of FETs to maintain the phase relation therebetween, the upper path further including transmission line stubs or elements which act as a delay line to compensate for the delay in the lower path due to the larger number of FETs therein. The outputs of the upper and lower paths are combined in a resistive combiner to provide the amplified signal. The output of this circuit is linear at low power and then demonstrates a knee therein at higher input power to resemble the curve of a logarithmic amplifier stage.

DESCRIPTION OF THE PREFERRED EMBODIMENT

Figure 1:
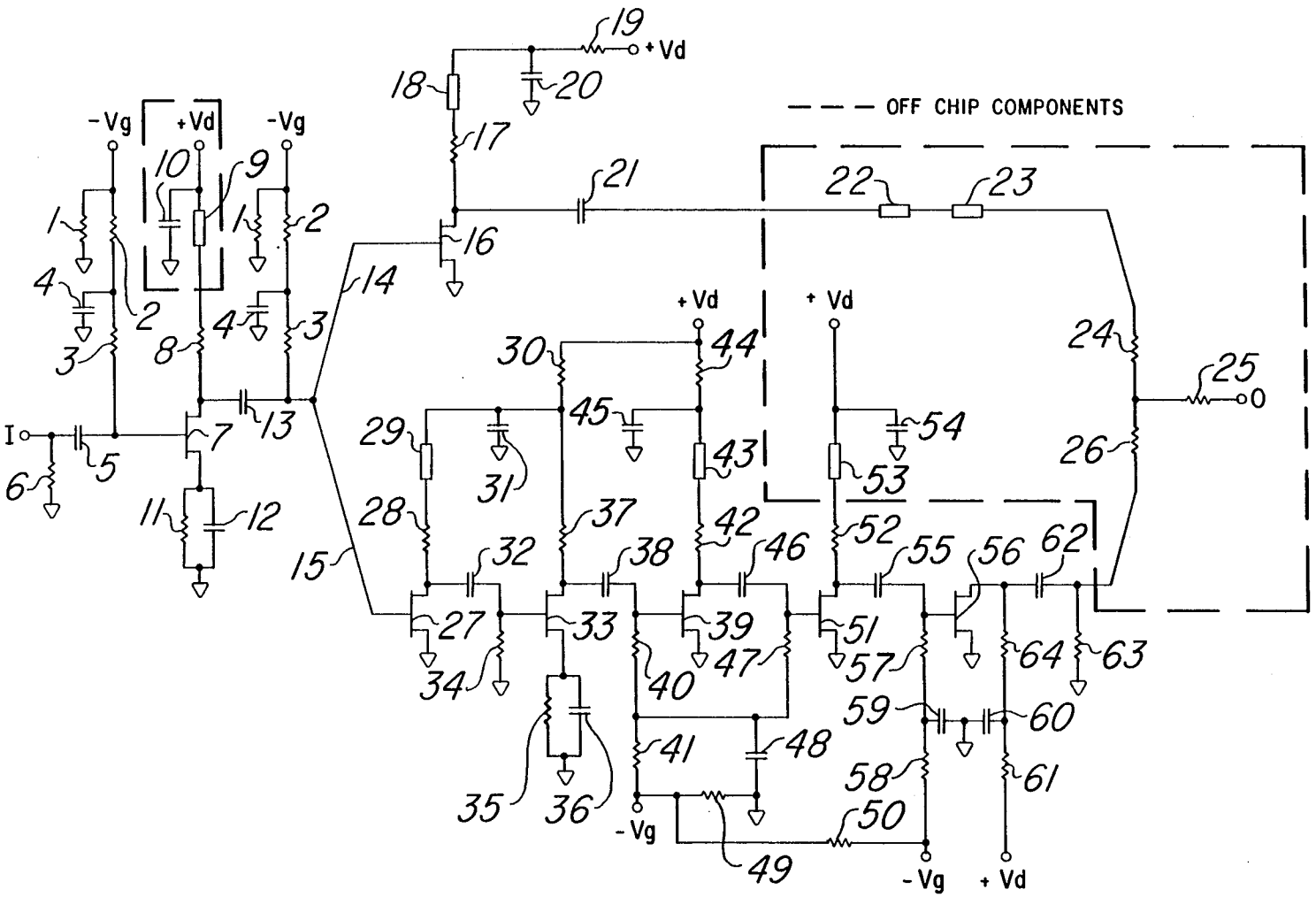
FIG. 1 is a schematic diagram of one dual gain stage of a true logarithmic amplifier in accordance with the present invention.
Figure 2:
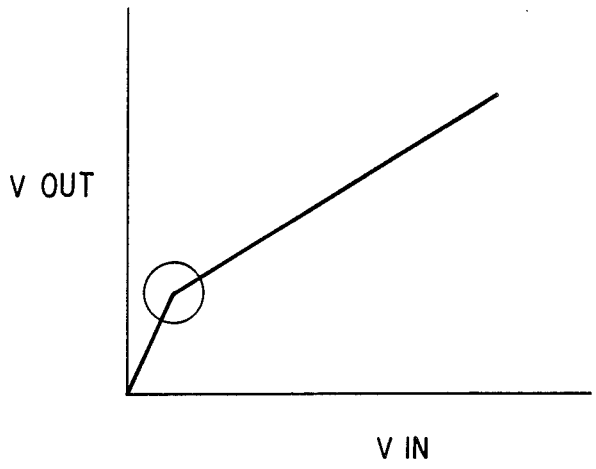
FIG. 2 is a graph of output voltage of the amplifier stage of FIG. 1 with respect to the input voltage thereto.

Referring now to FIG. 1, there is shown a schematic diagram of a GaAs monolithic true logarithmic amplifier in accordance with the present invention which operates in the range of 0.5 to 4 gigahertz. The entire circuit as shown except for the portions within the dotted lines are formed on a single GaAs semiconductor wafer with the circuitry shown within the dotted lines being disposed off chip. It should also be understood that the circuit of FIG. 1 represents one stage of an amplifier which can have one such stage or plural cascaded such stages with the output of one stage being the input to the following stage. It should also be understood that the term large FET as used herein refers to an FET having a 300 micron gate. A small FET has a 150 micron gate and a very small FET has a 50 micron gate. While these are preferred dimensions for the preferred embodiment, it should be understood that other dimensions and/or rations of dimension tailored to the specific requirement will be used without departing from the invention herein.

The circuit includes an input terminal I whereat input signals are applied to the circuit. The input signal is passed through an RC circuit composed of capacitor 5 and resistor 6 to the gate of FET 7 where resistor 6 ensures a good input match and capacitor 5 is for DC blocking. A circuit composed of a resistor between the negative voltage source and ground, a voltage divider composed of resistors 2 and 3 between the negative voltage source and the gate of transistor 7 and a capacitor 4 coupled between the junction of resistors 2 and 3 and ground applies a negative bias to the gate of FET 7.

The input signal is coupled to the gate of small FET 7 and controls operation thereof. FET 7 has a drain coupled to the positive voltage source via a gain shaping circuit composed of a resistor 8 and off chip components including a transmission line element 9 and a capacitor 10 coupled between the positive voltage source and ground. The source thereof is coupled to ground via the parallel connected resistor 11 and capacitor 12 which act as an additional gain shaping circuit. The output of FET 7 passes through coupling capacitor 13. At this point, the shaped and amplified output of FET 7 is split into an upper path 14 and a lower path 15.

The upper path includes a large FET 16 having the source coupled to ground and the drain coupled to the positive voltage source through a first resistor 17, a transmission line element 18 which is implemented as a rectangular inductor (coiled transmission line) and a second resistor 19, all connected in series. Transmission line 18 and resistor 17 provide greater resistance at lower frequencies than at higher frequencies. A capacitor 20 is connected between the junction of element 18 and resistor 19 and ground. The upper path signal is amplified by FET 16 and passes through coupling capacitor 21 to off chip transmission line elements which provide delay to compensate for the delay inherent in the lower element FETs. The upper path signal then passes through off chip resistor 24 and is then combined with the lower path signal (to be explained hereinbelow) when passing through off chip resistor 25.

The lower path includes a first amplification stage in the form of a small FET 27 having a source coupled to ground and the drain coupled to the positive voltage source through a first resistor 28, a transmission line element 29 and a second resistor 30, all connected in series. Transmission line 29 and resistor 28 provide greater resistance at lower frequencies than at higher frequencies. A capacitor 31 is connected between the junction of element 29 and resistor 30 to ground.

The output of FET 27 is coupled to the gate of a second amplification stage in the form of a small FET 33 through coupling capacitor 32. The gate of FET 33 is coupled to ground through resistor 34 whereas the source thereof is coupled to ground through a gain shaping circuit composed of parallel connected resistor 35 and capacitor 36. The drain of FET 33 is coupled to the positive voltage source via a resistor 37 which is coupled to the junction of resistor 30 and capacitor 31.

The output of FET 33 is coupled to the gate of a third amplification stage in the form of a small FET 39 through coupling capacitor 38. The gate of FET 39 is coupled to the negative voltage source through resistors 40 and 41 whereas the source thereof is coupled to ground. The drain of FET 39 is coupled to the positive voltage source via a resistor 42 and a transmission line element 43 in series, the latter being coupled to said voltage source via resistor 44. Transmission line 43 and resistor 42 provide greater resistance at lower frequencies than at higher frequencies. A capacitor 45 is coupled to ground from the junction of resistor 44 and element 43.

The output of FET 39 is coupled to the gate of a fourth amplification stage in the form of a small FET 51 through coupling capacitor 46. The gate of FET 51 is coupled to ground via a resistor 47 and a capacitor 48, the junction of these two elements being coupled to the junction of resistors 40 and 41. In addition, a resistor 49 is coupled between the negative voltage source and ground whereas a resistor 50 is coupled between sources of negative voltage. Resistor 50 permits both points to which it is coupled to be biased by the same voltage source, if desired. It also permits independent control of the limiting or very small FET 56, if desirable. The source of FET 51 is coupled to ground whereas the drain thereof is coupled through resistor 52 and off chip transmission line element 53 to the positive voltage source. An off chip capacitor 54 is also coupled between the positive voltage source and ground.

The output of FET 51 is coupled through coupling capacitor 55 to the gate of a fifth amplification stage in the form of a very small FET 56, said gate being coupled to the negative voltage source via series connected resistors 57 and 58, the junction of these resistors being coupled to ground via capacitor 59. The source of FET 56 is coupled to ground whereas the drain thereof is coupled to the positive voltage source through series connected resistors 64 and 61, the junction of these resistors being coupled to ground via capacitor 60. The output of FET 56 is coupled to the output via coupling capacitor 62 and resistor 63 coupled to ground and the junction of off chip resistor 26 and capacitor 62 to combine with the output of the upper path in the off chip resistor 25.

It should be understood that though a single FET has been shown in the upper path and five FETs have been shown in the lower path, it is merely necessary that the upper and lower path both have an odd or an even number of FETs in series to preserve the phase relation therebetween. Any delay in signal throughput due to the additional FETs in the circuit is balanced off by the elements 22 and 23 which provide the required delay to ensure that the upper and lower signals arrive at the resistive combiner composed of resistors 24, 25, and 26 simultaneously.

It should further be noted that since FET 16 is large, it provides lower gain and a higher compression point to the upper path. FET 56, on the hand , is very small and therefore provides higher gain and a lower compression point to the lower path. Accordingly, the desired relation between the upper and lower paths is achieved. In practice, the upper path preferably has unity gain and the lower path has a gain greater than unity. It is common that the lower path have a gain of 6.7 dB. All of the FETs in the path will contribute to the gain of that path. The last FET in the path sets the compression point. Furthermore, to overcome losses in the resistive combiner, 6 dB of additional gain is added to each path, making the gain of the upper path 6 db and the gain of the lower path 12.7 dB.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

We claim:

1. A monolithic true logarithmic amplifier which comprises:

(a) a semiconductor chip including an input terminal and an output terminal;

(b) first and second parallel independent circuit paths coupled to said input terminal;

(c) said first circuit path including at least one serially connected amplifier and a delay circuit in series therewith;

(d) said second circuit path including m +2n serially connected amplifiers, where m is the number of amplifiers in said first circuit path and n is an integer greater than zero, the delay of said delay circuit being equal to the delay in said 2n amplifiers; and (e) means coupled to said output terminal to combine the signals emanating from said first and second circuit paths.

2. An amplifier as set forth in claim 1 wherein said amplifiers are all GaAs FETs.

3. An amplifier as set forth in claim 1 wherein one of said amplifiers in said first circuit path has a gate width greater than the gate width of the amplifiers in said second circuit path.

4. An amplifier as set forth in claim 2 wherein one of said amplifiers in said first circuit path has a gate width greater than the gate width of the amplifiers in said second circuit path.

5. An amplifier as set forth in claim 1 wherein one of said amplifiers in said second circuit path has a gate width smaller than the gate width of the remaining amplifiers in said second circuit path and the amplifiers in said first circuit path.

6. An amplifier as set forth in claim 2 wherein one of said amplifiers in said second circuit path has a gate width smaller than the gate width of the remaining amplifiers in said second circuit path and the amplifiers in said first circuit path.

7. An amplifier as set forth in claim 3 wherein one of said amplifiers in said second circuit path has a gate width smaller than the gate width of the remaining amplifiers in said second circuit path and the amplifiers in said first circuit path.

8. An amplifier as set forth in claim 4 wherein one of said amplifiers in said second circuit path has a gate width smaller than the gate width of the remaining amplifiers in said second circuit path and the amplifiers in said first circuit path.

9. An amplifier as set forth in claim 1 wherein said delay circuit comprises a transmission line element disposed external to said chip.

10. An amplifier as set forth in claim 2 wherein said delay circuit comprises a transmission line element disposed external to said chip.

11. An amplifier as set forth in claim 3 wherein said delay circuit comprises a transmission line element disposed external to said chip.

12. An amplifier as set forth in claim 4 wherein said delay circuit comprises a transmission line element disposed external to said chip.

13. An amplifier as set forth in claim 5 wherein said delay circuit comprises a transmission line element disposed external to said chip.

14. An amplifier as set forth in claim 6 wherein said delay circuit comprises a transmission line element disposed external to said chip.

15. An amplifier as set forth in claim 7 wherein said delay circuit comprises a transmission line element disposed external to said chip.

16. An amplifier as set forth in claim 8 wherein said delay circuit comprises a transmission line element disposed external to said chip.

17. An amplifier as set forth in claim 1, further including a first amplifier on said semiconductor chip having an input coupled to said input terminal and an output coupled to said first and second parallel circuits.

18. An amplifier as set forth in claim 4, further including a first amplifier on said semiconductor chip having an input coupled to said input terminal and an output coupled to said first and second parallel circuits.

19. An amplifier as set forth in claim 8, further including a first amplifier on said semiconductor chip having an input coupled to said input terminal and an output coupled to said first and second parallel circuits

20. An amplifier as set forth in claim 16, further including a first amplifier on said semiconductor chip having an input coupled to said input terminal and an output coupled to said first and second parallel circuits.

21. A monolithic true logarithmic amplifier which comprises:

(a) a semiconductor chip including an input terminal and an output terminal;

(b) first and second parallel independent circuit paths coupled to said input terminal;

(c) said first circuit path being a high gain, low compression circuit path;

(d) said second circuit path being a low gain, high compression path relative to said first path; and (e) means coupled to said output terminal to combine the signals emanating from said first and second circuit paths.

22. A true logarithmic amplifier as set forth in claim 21 wherein each of said first and second paths include at least one MESFET amplifier, the width of the gate of said amplifier in said first path being greater than the width of the gate of said amplifier in said second path.

23. A true logarithmic amplifier as set forth in claim 21 wherein said second path includes a plurality of MESFET amplifiers, one of said amplifiers in said second path having a gate width smaller than the gate width of the remaining amplifiers in said second circuit path.

24. A true logarithmic amplifier as set forth in claim 22 wherein said second path includes a plurality of MESFET amplifiers, one of said amplifiers in said second path having a gate width smaller than the gate width of the remaining amplifiers in said second circuit path.

25. A monolithic true logarithmic amplifier which comprises:

(a) a semiconductor chip including an input terminal and an output terminal;

(b) first and second parallel independent circuit paths coupled to said input terminal;

(c) said first circuit path being a high gain, low compression circuit path;

(d) said second circuit path being a low gain, high compression path relative to said first path which includes a plurality of MESFET amplifiers, one of said amplifiers in said second path having a gate width smaller than the gate width of the remaining amplifiers in said second circuit path; and (e) means coupled to said output terminal to combine the signals emanating from said first and second circuit paths.

26. A monolithic true logarithmic amplifier as set forth in claim 25 wherein said first circuit path includes at least one serially connected amplifier and a delay circuit in series therewith and said second circuit path includes $m+2n$ serially connected amplifiers, where m is the number of amplifiers in said first circuit path and n is an integer greater than zero, the delay of said delay circuit being equal to the delay in said 2n amplifiers.

* * * * *